US008852144B2

(12) United States Patent
Al-Thallab

(10) Patent No.: US 8,852,144 B2
(45) Date of Patent: Oct. 7, 2014

(54) NURSING DEVICE

(76) Inventor: Fatema S. Al-Thallab, Jahra (KW)

( * ) Notice: Subject to any disclaimer, the term of this patent is extended or adjusted under 35 U.S.C. 154(b) by 390 days.

(21) Appl. No.: 11/370,045

(22) Filed: Mar. 8, 2006

(65) Prior Publication Data

US 2007/0235405 A1 Oct. 11, 2007

(51) Int. Cl.
*A61J 9/00* (2006.01)
*A61J 11/00* (2006.01)

(52) U.S. Cl.
CPC ..... *A61J 9/00* (2013.01); *A61J 11/0005* (2013.01); *A61J 11/001* (2013.01); *A61J 9/006* (2013.01)
USPC ..... 604/77; 215/11.1; 215/388; 604/67; 604/76

(58) Field of Classification Search
CPC ..... A61J 11/04; A61J 7/0053; A61J 9/00; F04D 13/14; A61M 31/00
USPC ..... 604/234–236, 67, 76–79; 215/11.1–11.6, 388
See application file for complete search history.

(56) References Cited

U.S. PATENT DOCUMENTS 4,856,663 A * 8/1989 Epp ..... 215/11.1
4,884,013 A * 11/1989 Jackson et al. ..... 318/481
4,966,580 A * 10/1990 Turner et al. ..... 604/67
4,994,076 A * 2/1991 Guss ..... 606/236
5,531,338 A * 7/1996 Sklar ..... 215/11.1
5,853,387 A * 12/1998 Clegg et al. ..... 606/67
6,023,639 A * 2/2000 Hakky et al. ..... 604/20
2004/0188372 A1* 9/2004 Ruth et al. ..... 215/11.4
2008/0039778 A1* 2/2008 Goldie et al. ..... 604/67

OTHER PUBLICATIONS

Peristaltic Pump. Mosby's Dictionary of Medicine, Nursing & Health Professions. Accessed Dec. 5, 2013.*
Solenoid. Encyclopedia Britannica, Academic Edition. Accessed Dec. 5, 2013.*

* cited by examiner

*Primary Examiner* — Bhisma Mehta
*Assistant Examiner* — Matthew A Engel
(74) *Attorney, Agent, or Firm* — Lowe Hauptman & Ham, LLP

(57) ABSTRACT

A nursing device for feeding infants with a cleft lip and/or cleft palate includes upper and lower portions. The upper portion includes a bottle with an opening in its top for containing a liquid, a nipple and a screw cap for maintaining the nipple in sealing engagement with the opening. A submersible pump is disposed in the bottom of the bottle and connected to an opening in the nipple by a tube. A lower portion of the device includes a motor and a magnetic coupling for activating the pump. A microprocessor control timer regulates the timing and flow of a feeding cycle with a display for help in regulating the feeding cycle.

4 Claims, 2 Drawing Sheets

FIG. 1
(PRIOR ART)
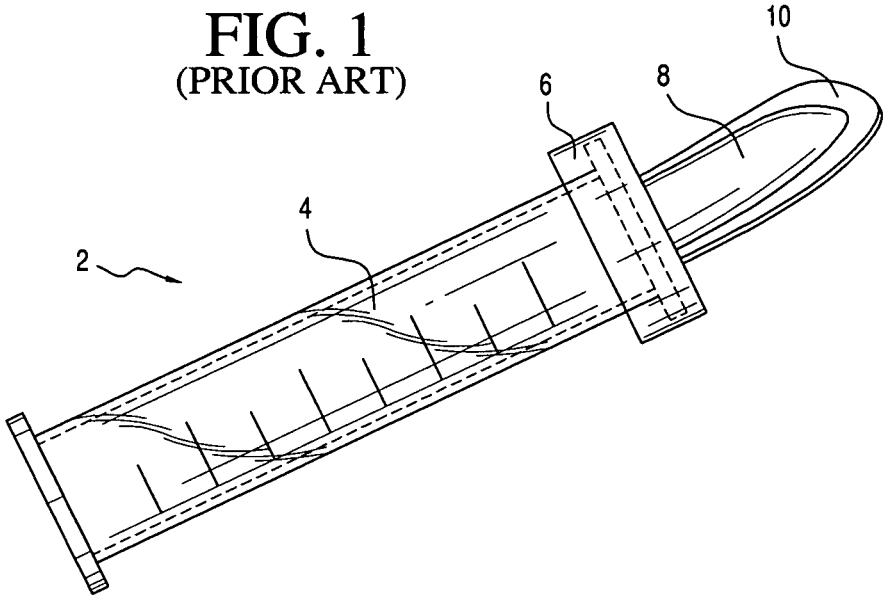
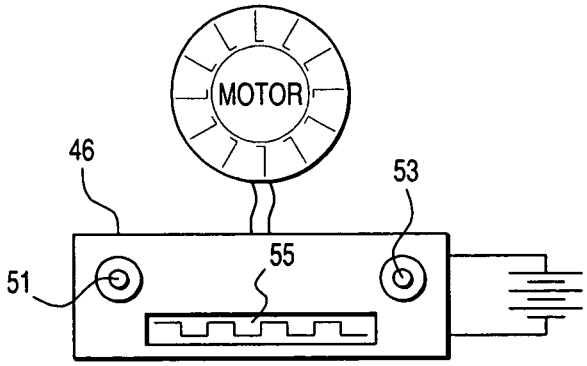
FIG. 3

NURSING DEVICE

FIELD OF THE INVENTION

This invention relates to a nursing device and more particularly to a nursing bottle for infants with a cleft lip and/or cleft palate.

BACKGROUND FOR THE INVENTION

Cleft lips and cleft palates are common birth defects and require special attention during the initial six months of a child's life. To be more specific, there are three types of cleft lip i.e. unilateral incomplete, unilateral complete and bi-lateral complete. There are also three types of cleft palates, namely the soft palate only, the unilateral complete and the bilateral complete. However, each of the cleft lip and/or cleft palate malformations involves leakage of air from the mouth through the nose which causes an infant to be unable to suck, causing regurgitation of fluids through the nose and difficulty in swallowing and breathing.

For a period of about six months until the infant has matured enough for corrective surgery, the infant must be fed. Feeding is not only the most immediate problem encountered in the daily care of an infant with a cleft lip and/or cleft palate, but it is one of the more difficult to solve and the most necessary for the survival of the child.

A U.S. patent of Fepp U.S. Pat. No. 4,856,663 discloses a nursing device for infants with a cleft lip or cleft palate. As disclosed, the device comprises a solid duckbill shaped shield with an incorporated nipple on its underside together with means for interconnecting the nipple and a baby bottle or breast. The shield acts to seal the cleft palate while keeping the nipple from collapsing into the cleft palate and cleft lip to allow an infant to suck liquids from a bottle or the breast.

A French Patent No. 2,622,102 A1 of Michel Grateau discloses a control device with feedback for artificial feeding systems for force-feeding of infants. The device that is fitted into a nursing bottle allows a caregiver to control the feeding device.

A more recent U.S. patent of Goldfield, U.S. Pat. No. 6,033,367 discloses a smart bottle and system for neonatal nursing. The system for diagnosing or monitoring sucking/swallowing/breathing of an impaired neonate includes a processor for receiving a signal from a breath sensor. The system develops an output for intraaral tactical or flow control feedback. In a feeding or monitoring embodiment the processor applies a signal to control a liquid feeding valve, which supplies nutrients through a feeding nipple. In another embodiment, adapted for manual feeding, the processor displays a wave form indicative of the breath or airflow sensor output and a manually operated pressure bulb is provided to allow a nurse to apply arrhythmic muscular pressure stimulus via a feeding or surrogate nipple in a manner visually synchronized with the displayed breath activity.

Notwithstanding the above, it is presently believed that there is a need for and a commercial potential for an improved feeding device in accordance with the present invention. There should be a demand for such devices because the devices pump measured amounts of milk in pre-selected periods of time to overcome the difficulties in feeding children with cleft lips and cleft palates. Further, the devices in accordance with the invention include a nipple so that a baby can develop an ability to suck and at the same time to exercise and message the muscles of the face. In some cases, a baby can not cope with swallowing because of the defect in the palate. However, with the devices in accordance with the present invention, a nurse or mother can pump measured amounts of nutrient so that the child obtains enough nutrients in enough time without adversely affecting their general condition.

The devices in accordance with the present invention are also applicable for pre-natal infants i.e. those born before 32 weeks. The suction reflux in such infants may not be fully developed and the child may choke on nutrient from an ordinary bottle. Such choking may lead to infection. Further, the use of the present invention may allow the infant to leave the hospital at an earlier time since the mother will be able to feed the child at home. Another advantage of the device is that it has a nipple that helps in developing a child's ability to suck.

Further, children with special needs that have a problem with swallowing may also benefit from the use of the devices in accordance with the invention. Still further, the devices avoid a problem associated with spilling relatively large amounts of milk during feeding. Also, such devices can be used to feed fluid foods to elderly people who are having feeding problems.

BRIEF SUMMARY OF THE INVENTION

In essence, the present invention contemplates a nursing device or baby's bottle for feeding infants with a cleft lip or cleft palate. The nursing device includes an upper portion including a bottle for containing a supply of nutrients and/or water with an opening at one end thereof. The upper portion also includes a nipple and means for maintaining the nipple in sealing engagement with the top of the bottle. In a preferred embodiment of the invention, the top of the bottle includes a threaded neck portion around the opening and is adapted to receive a conventional cap thereon. The cap includes a central opening adapted to receive a nipple therein and internal threads for engaging the external threads on the bottle. Thus, tightening the cap squeezes a flange on the outer portion of the nipple between the top of the bottle and the underside of the cap to form a liquid tight seal. A pump is disposed in the bottle, below the surface of the liquid nutrient or water and preferably near or on the bottom of the bottle. Tubular means such as a flexible hose or semi-rigid or rigid conduit connects an output of the pump with a forward portion of the nipple for delivering pre-selected amounts of nutrients or water through the nipple and into an infant's mouth. A lower portion of the device includes a housing and a motor disposed in the housing for rotating the pump through a magnetic coupling. An important feature of the present invention resides in means such as a timer for regulating the amount of nutrient or water pumped in a given period of time. The timer may also include means for regulating the cycle.

The invention will now be described in connection with the following drawings wherein like reference numerals have been used to define like parts.

DESCRIPTION OF THE FIGURES

FIG. 1 is a side elevational view of a prior art nursing bottle for children with cleft lips and/or cleft palates;

FIG. 3 is a schematic illustration of a programmable timer for use in the present invention.

DESCRIPTION OF THE PREFERRED EMBODIMENTS OF THE INVENTION

Figure 4:
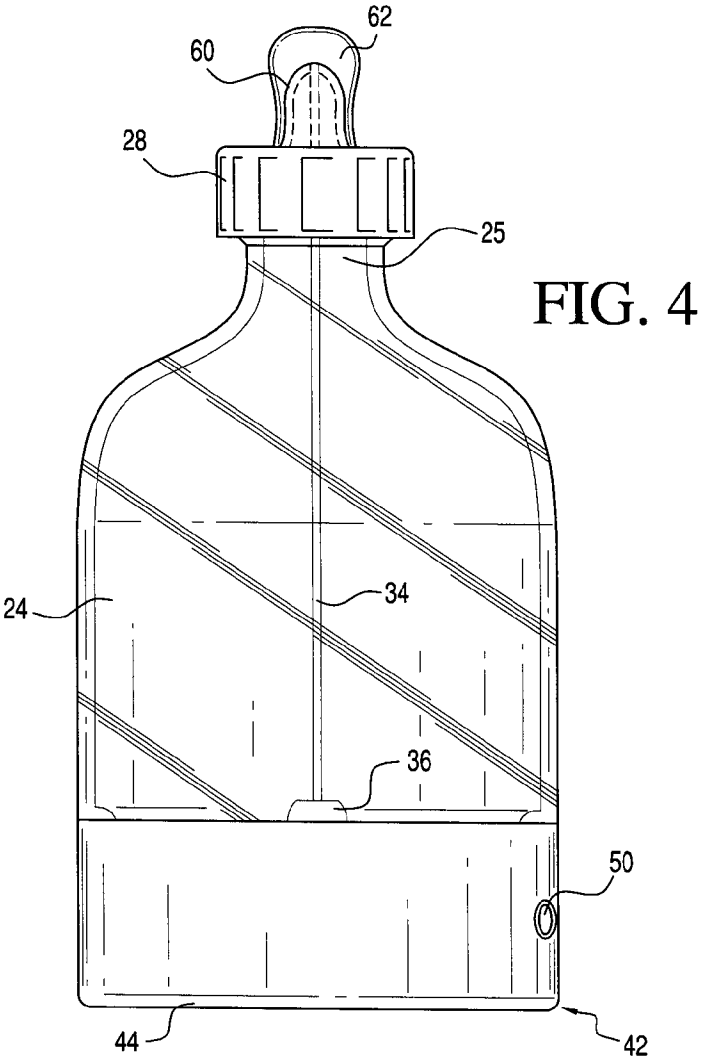
FIG. 4 is a cross-sectional view of a nursing bottle according to a second embodiment of the invention.
Figure 2:
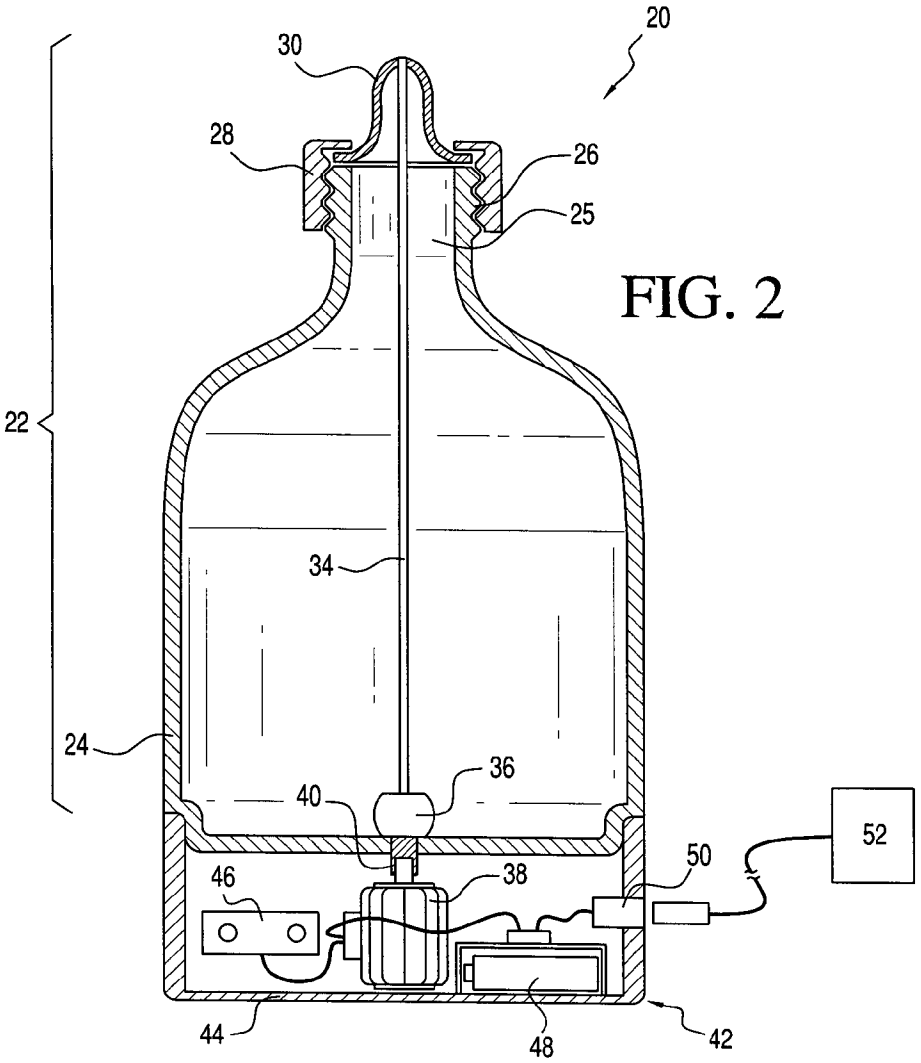
FIG. 2 is a cross-sectional view of a nursing bottle in accordance with the present invention.

A prior art baby bottle for feeding children with a cleft lip and/or a cleft palate is shown in FIG. 1. As shown, a conventional baby's bottle 2 includes an elongated container 4 having an open end with an external thread (not shown) formed thereon. A conventional cap 6 has an opening therein and a internal threaded portion and a nipple 8 extends there through as attached to the top of the bottle in a conventional manner. However, the nipple 8 includes a substantially solid thin shield of latex rubber or the like. The shield is designed and constructed to prevent the nipple from collapsing into a cleft palate.

A nursing bottle 20 in accordance with the present invention includes an upper section 22 having an elongated bottle 24 which is shaped like a conventional baby's bottle and made of glass or suitable plastic material. Like conventional bottles, the elongated bottles are preferable clear or translucent so that a caregiver can monitor the amount of nutrient which is dispensed. The bottle 24 also includes an opening 25 in an upper portion thereof, and a threaded neck 26 surrounds the opening 25. The threaded neck 25 is constructed and dimensioned to receive a threaded cap 28 with a nipple 30 extending through an opening in the cap 28 in a conventional manner. As in a conventional baby's bottle, the nipple 30 includes a peripheral flange at a base thereof. This flange is compressed between a top of the cap 28 and top of the neck 26.

Unlike a conventional baby's bottle, the nursing device 20 includes an elongated tubular member 34, which passes through the nipple from a forward opening in a nipple for delivering liquid such as milk or water to an infant. The tubular member may be flexible, semi-flexible or relatively rigid and of a suitable plastic material and is connected to a small submersible rotary pump for delivering pre-selected amounts of liquid to an infant.

A small rotateable submersible pump 36, the output of which is connected to the tube 34 is disposed in the bottom of the bottle 24. The pump 36 is connected to a motor 38 through a magnetic coupling 40 (shown schematically). The motor 38 is disposed in a lower section 42 of the device.

The lower section 42 includes a plastic housing 44, which is attached to the bottom of the bottle 24 in any conventional manner. A programmable timer 46 of conventional design regulates the motor 38 in order to provide a selected volume of liquid to an infant and may be programmed to provide small amounts of liquid with intermittent pauses to provide a more natural feeding. A battery 48 is disposed in the lower section 42 for powering the motor 38 and includes means 50 for connecting the batteries to an external charger 52, which is connected to a source of electricity in a conventional manner.

The programmable timer 46 is shown schematically in FIG. 3 and typically includes a microprocessor control the programming of which is well within the ability of a person of ordinary skill in the art. The timer is also of conventional design and regulates the volume of liquid pumped and the length of pauses between pumping for each feeding cycle. The volume of liquid may be adjusted by a knob 51 and the timing for a pause by a knob 53. A LED display 55 may also be provided as an indication of volume as for example the height or amplitude shown on the display or the pause indicated by ½ wavelength.

A further embodiment of the invention, which is similar to the first embodiment, is illustrated in FIG. 4. The difference is the nipple 30 shown in FIG. 4 is replaced with a nipple 60 having a soft rubber shield 62 for covering the defect of the baby's mouth to thereby prevent milk for leakage due to a cleft lip or cleft palate.

While the invention has been described in connection with its preferred embodiments, it should be recognized the changes and modifications may be made therein without departing from the scope of the appended claims.

What is claimed is:

1. A nursing device for feeding infants with a cleft lip or cleft palate, said device comprising:

an upper portion including a clear or transparent bottle having an opening at an upper end thereof and a closed bottom portion for containing a supply of liquid;

a nipple and means for maintaining said nipple in sealing engagement with said opening in said bottle, and in which said nipple includes a thin soft rubber shield constructed and dimensioned to cover a defect of an infant's mouth to thereby prevent liquid leakage due to a cleft lip or cleft palate;

a submersible rotary pump disposed in said closed bottom portion of said bottle and a tubular member passing through said nipple from a forward opening in said nipple and connected to said submersible rotary pump for delivering pre-selected volumes of liquid from the bottle and through the nipple for feeding an infant;

a lower portion of said device isolated from said fluid containing closed bottom portion of said bottle and including a housing, a motor including an output shaft disposed within said housing and a magnetic coupling extending through said closed bottom portion of said bottle for driving said pump in response to rotation of said output shaft of said motor;

a programmable timer for selecting an amount of liquid to be delivered to an infant in a cycle and regulating the volume of liquid pumped and the length of pauses between pumping for each feeding cycle and in which said timer includes a visual display to illustrate the relative volume of liquid pumped and timed intervals in a feeding cycle in said lower portion of said device;

a first knob for adjusting the volume of liquid pumped and a second knob for adjusting the time for a pause and an LED display for indicating the volume of liquid pumped and length of a pause disposed in said lower portion of said device; and a battery for powering said motor and means for connecting said battery to a charger.

2. A nursing device for feeding an infant with a cleft lip or cleft palate according to claim 1 which includes means for maintaining said nipple in sealing engagement with said opening includes an outer flange on said nipple and a screw cap threadedly attached to said bottle to force said flange against said opening.

3. A nursing device for feeding infants with a cleft lip or cleft palate according to claim 1 in which said bottle and said housing are made of plastic.

4. A nursing device for feeding infants with a cleft lip or cleft palate according to claim 1 in which said programmable timer includes a microprocessor control.

* * * * *